US011098634B2

(12) United States Patent
Koszewnik

(10) Patent No.: US 11,098,634 B2
(45) Date of Patent: Aug. 24, 2021

(54) EXHAUST MANIFOLD CONSTRUCTIONS INCLUDING THERMAL BARRIER COATINGS FOR OPPOSED-PISTON ENGINES

(71) Applicant: ACHATES POWER, INC., San Diego, CA (US)

(72) Inventor: John Koszewnik, San Diego, CA (US)

(73) Assignee: Achates Power, Inc., San Diego, CA (US)

( * ) Notice: Subject to any disclaimer, the term of this patent is extended or adjusted under 35 U.S.C. 154(b) by 0 days.

(21) Appl. No.: 16/783,067

(22) Filed: Feb. 5, 2020

(65) Prior Publication Data

US 2020/0173334 A1 Jun. 4, 2020

Related U.S. Application Data

(63) Continuation of application No. PCT/US2018/045324, filed on Aug. 6, 2018.
(Continued)

(51) Int. Cl.
*F01N 13/10* (2010.01)
*F01N 13/16* (2010.01)
(Continued)

(52) U.S. Cl.
CPC ..... *F01N 13/102* (2013.01); *F01N 13/10* (2013.01); *F01N 13/105* (2013.01); *F01N 13/107* (2013.01); *F01N 13/16* (2013.01); *F02B 25/08* (2013.01); *F02B 75/28* (2013.01); *F02B 75/282* (2013.01); *F01N 2510/02* (2013.01)

(58) Field of Classification Search
CPC ..... F01N 13/10; F01N 13/102; F01N 13/105; F01N 13/107; F01N 13/16; F01N 2510/02; F02B 25/08; F02B 75/28; F02B 75/282
See application file for complete search history.

(56) References Cited

U.S. PATENT DOCUMENTS 1,517,634 A 12/1924 Junkers ..... 60/321
5,937,643 A 8/1999 Wang ..... 60/323
(Continued)

FOREIGN PATENT DOCUMENTS

EP 2860284 A1 4/2015
GB 2086470 A 5/1982
(Continued)

OTHER PUBLICATIONS

International Search Report and Written Opinion dated Oct. 10, 2018, for PCT application No. PCT/US2018/045324.
(Continued)

*Primary Examiner* — Audrey K Bradley
(74) *Attorney, Agent, or Firm* — Terrance A. Meador; Julie J. Muyco

(57) ABSTRACT

An exhaust manifold assembly with a thermal barrier coating for an opposed-piston engine reduces heat rejection to coolant, while increasing exhaust temperatures, fuel efficiency, and quicker exhaust after-treatment light-off. The exhaust manifold assembly can include a coating on the inside surface of the manifold assembly. The coated exhaust manifold assembly can ensure structural robustness of the exhaust manifold assembly over a larger range of operating temperatures.

12 Claims, 5 Drawing Sheets

Related U.S. Application Data

(60) Provisional application No. 62/547,364, filed on Aug. 18, 2017.

(51) Int. Cl.
*F02B 25/08* (2006.01)
*F02B 75/28* (2006.01)

(56) References Cited

U.S. PATENT DOCUMENTS

| | | | | |
|---|---|---|---|---|
| 9,551,220 | B2 | 1/2017 | Fuqua et al. | 60/597 |
| 9,581,024 | B2 | 2/2017 | Fuqua et al. | 60/597 |
| 9,845,764 | B2 | 12/2017 | Koszewnik et al. | 7/12 |
| 10,001,057 | B2 | 6/2018 | Fuqua | 60/612 |
| 2004/0006871 | A1* | 1/2004 | Sturtevant | F01N 13/18 29/890.08 |
| 2015/0300241 | A1* | 10/2015 | Holland | F02B 25/00 123/299 |
| 2015/0337728 | A1* | 11/2015 | Fuqua | F02M 35/10157 60/597 |
| 2016/0032824 | A1 | 2/2016 | Fuqua | 60/612 |
| 2016/0290277 | A1 | 10/2016 | Koszewnik et al. | 123/51 R |
| 2017/0145914 | A1 | 5/2017 | Lineton et al. | F02B 77/11 |
| 2017/0211457 | A1 | 7/2017 | Kuhlbach et al. | F01N 13/102 |

FOREIGN PATENT DOCUMENTS

| | | | | |
|---|---|---|---|---|
| JP | S613914 | U | 1/1986 | |
| JP | H08189336 | A | 7/1996 | |
| WO | WO-92/22736 | A2 | 12/1992 | |
| WO | WO-2010/059080 | A1 | 5/2010 | |
| WO | WO-2015/179116 | A1 | 11/2015 | |
| WO | WO-2015/179117 | A1 | 11/2015 | |
| WO | WO-2016077425 | A1 * | 5/2016 | F02B 75/24 |

OTHER PUBLICATIONS

International Search Report and Written Opinion dated Oct. 23, 2018 for PCT application No. PCT/US2018/045650.

Blomqvist, Christoffer, "Thermal Barrier Coatings for Diesel Engine Exhaust Application", Degree Project for Master of Science in Engineering, Mechanical Engineering, Karlstads University, Jun. 9, 2014.

Boyer, Howard E., "Atlas of Fatigue Curves," figure 10-2, p. 246, published Dec. 31, 1985 by ASM International.

Kosaka, Hidemasa, et al., "Concept of 'Temperature Swing Heat Insulation' in Combustion Chamber Walls, and Appropriate Thermo-Physical Properties for Heat Insulation Coat", *SAE International Journal of Engines*, vol. 6, Issue 1 (May 2013).

Shimizu, Naoshige, "Toyota Applies Newly-developed Film to High-efficiency Diesel Engine (1)", *XTECH*, published Jun. 3, 2015 by Nikkei Business Publications, Inc.

Stang, John H., "Designing Adiabatic Engine Components", *SAE Technical Paper 780069*, published Feb. 1, 1978 by Society of Automotive Engineers, Inc.

"Toyota Unveils New Diesels With Advanced Thermal Insulation Combustion; 15% More Fuel Efficient, 25% More Torque; 44% Thermal Efficiency", published Jun. 19, 2015 in *Green Car Congress*, https://www.greencarcongress.com/2015/06/20150619-toytotagd.html.

* cited by examiner

FIG. 3
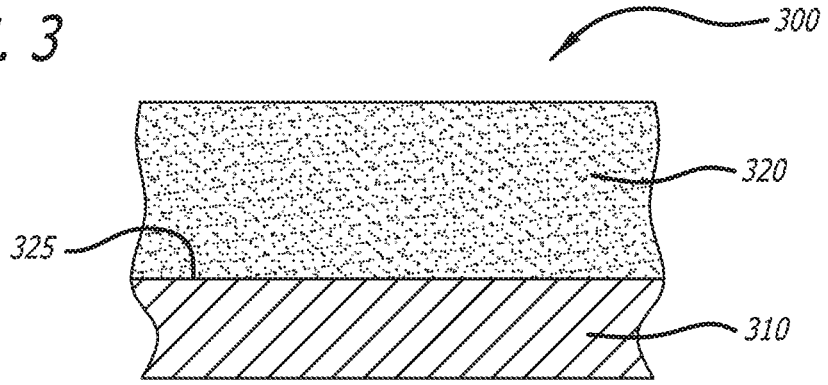
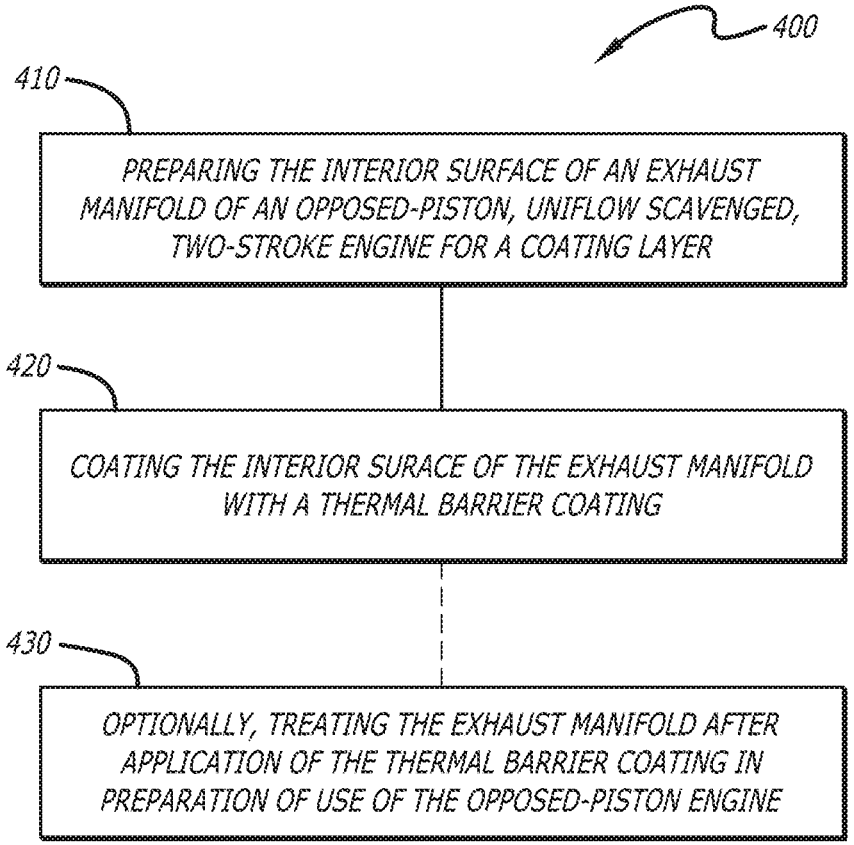
FIG. 4

EXHAUST MANIFOLD CONSTRUCTIONS INCLUDING THERMAL BARRIER COATINGS FOR OPPOSED-PISTON ENGINES

CROSS-REFERENCE TO RELATED APPLICATIONS

This application is a continuation of International Patent Application number PCT/US2018/045324, titled "Exhaust Manifold Constructions Including Thermal Barrier Coatings for Opposed-Piston Engines", filed Aug. 6, 2018, which claims priority to U.S. Provisional Patent Application No. 62/547,364, titled "Exhaust Manifold Constructions Including Thermal Barrier Coatings for Opposed-Piston Engines," filed Aug. 18, 2017.

This application contains subject matter related to that of commonly-owned U.S. patent application Ser. No. 14/450,808, filed Aug. 4, 2014, "Exhaust Layout With Accompanying Firing Sequence For Two-Stroke Cycle, Inline, Opposed-Piston Engines," now U.S. Pat. No. 10,001,057, issued Jun. 19, 2018; Ser. No. 14/284,058, filed May 21, 2014, "Air Handling Constructions for Opposed-Piston Engines," now U.S. Pat. No. 9,581,024, issued Feb. 28, 2017; and Ser. No. 14/284,134, filed May 21, 2014, "Open Intake and Exhaust Chamber Constructions for an Air Handling System of an Opposed-Piston Engine," now U.S. Pat. No. 9,551,220, issued Jan. 24, 2017.

FIELD

The field concerns internal combustion engines. In particular, the field relates to opposed-piston engines which may be applied to vehicles, vessels, and stationary power sources.

BACKGROUND

A two-stroke cycle engine is an internal combustion engine that completes a cycle of operation with a single complete rotation of a crankshaft and two strokes of a piston connected to the crankshaft. The strokes are typically denoted as compression and power strokes. One example of a two-stroke cycle engine is an opposed-piston engine in which two pistons are disposed in the bore of a cylinder for reciprocating movement in opposing directions along the central axis of the cylinder. Each piston moves between a bottom dead center (BDC) location where it is nearest one end of the cylinder and a top dead center (TDC) location where it is furthest from the one end. The cylinder has ports formed in the cylinder sidewall near respective BDC piston locations. Each of the opposed pistons controls one of the ports, opening the port as it moves to its BDC location, and closing the port as it moves from BDC toward its TDC location. One of the ports serves to admit charge air into the bore, the other provides passage for the products of combustion out of the bore; these are respectively termed "intake" and "exhaust" ports (in some descriptions, intake ports are referred to as "air" ports or "scavenge" ports). In a uniflow-scavenged opposed-piston engine, pressurized charge air enters a cylinder through its intake port as exhaust gas flows out of its exhaust port, thus gas flows through the cylinder in a single direction ("uniflow") along the length of the cylinder, from intake port to exhaust port.

Charge air and exhaust products flow through the cylinder via an air handling system (also called a "gas exchange" system). Fuel is delivered by injection from a fuel delivery system. As the engine cycles, a control mechanization governs combustion by operating the air handling and fuel delivery systems in response to engine operating conditions. The air handling system may be equipped with an exhaust gas recirculation ("EGR") system to reduce production of undesirable compounds during combustion.

In an opposed-piston engine, the air handling system moves fresh air into and transports combustion gases (exhaust) out of the engine, which requires pumping work. The pumping work may be done by a gas-turbine driven pump, such as a compressor (e.g., a turbocharger), and/or by a mechanically-driven pump, such as a supercharger. In some instances, the compressor unit of a turbocharger may be located upstream or downstream of a supercharger in a two-stage pumping configuration. The pumping arrangement (single stage, two-stage, or otherwise) can drive the scavenging process, which is critical to ensuring effective combustion, increasing the engine's indicated thermal efficiency, and extending the lives of engine components such as pistons, rings, and cylinders. Additionally, pressure and suction waves in the intake and exhaust can also provide pumping work. The pumping work also drives an exhaust gas recirculation system.

Opposed-piston engines have included various constructions designed to transport engine gasses (charge air, exhaust) into and out of the cylinders. For example, U.S. Pat. No. 1,517,634 describes an early opposed-piston aircraft engine that made use of a multi-pipe exhaust manifold having a pipe in communication with the exhaust area of each cylinder that merged with the pipes of the other cylinders into one exhaust pipe. The manifold was mounted to one side of the engine.

In the 1930s, the Jumo 205 family of opposed-piston aircraft engines defined a basic air handling architecture for dual-crankshaft opposed-piston engines. The Jumo engine included an inline cylinder block with six cylinders. The construction of the cylinder block included individual compartments for exhaust and intake ports. Manifolds and conduits constructed to serve the individualized ports were attached to or formed on the cylinder block. Thus, the engine was equipped with multi-pipe exhaust manifolds that bolted to opposite sides of the engine so as to place a respective pair of opposing pipes in communication with the annular exhaust area of each cylinder. The output pipe of each exhaust manifold was connected to a respective one of two entries to a turbine. The engine was also equipped with intake conduits located on opposing sides of the engine that channeled charge air to the individual intake areas of the cylinders. A two-stage pressure charging system provided pressurized charge air for the intake conduits.

The prior art exhaust manifolds extracted a penalty in increased engine size and weight. Each individual pipe required structural support in order to closely couple the pipe opening with the annular exhaust space of a cylinder. Typically, the support was in the form of a flange at the end of each pipe with an area sufficient to receive threaded fasteners for fastening the flange to a corresponding area on a side of the cylinder block. The flanges of each manifold were arranged row-wise in order to match the inline arrangement of the cylinders. The width of the ducts connected to these flanges restricted cylinder-to-cylinder spacing, which required the engine to be comparatively heavy and large.

In modern vehicle engines, size, weight and performance, both in terms of power and emissions, are factors that are balanced in designing engine components. It is desirable to minimize the engine space that receives exhaust from the cylinders after each combustion event so as to reduce size and weight and improve performance.

It is desirable to retain as much heat as possible in the exhaust gas discharged into the exhaust manifold in order to maximize the thermal energy extracted downstream for useful purposes such as driving a turbine and energizing after treatment devices (e.g., providing heat for catalysis). However, heat can be lost by conduction through the structures and surfaces of the exhaust manifold. Once received in the surrounding structure, heat is conducted from the cylinder block (i.e., engine block) by an engine cooling system in order to limit thermal stress on the cylinder block. Thermal energy lost in this way is said to be "rejected" to the coolant. Circulation of the coolant adds to parasitic engine losses. Therefore, it is desirable to reduce the transfer of heat from the exhaust gas to structures and surfaces of the exhaust manifold which surround the space into which the exhaust gas is expelled from the exhaust ports so as to enhance the thermal efficiency of the engine.

SUMMARY

In some implementations an opposed-piston engine is provided with an exhaust manifold assembly construction that has one or more thermal barrier coatings. The exhaust manifold assembly can include an inside surface and the thermal barrier coating can be on the inside surface.

The following features can be present in the exhaust manifold assembly and/or in the engine in any suitable combination. The thermal barrier coating can include a thermally insulating material, and in some implementations, the thermally insulating material can have a low coefficient of thermal conductivity. The coating can include any of zirconia, alumina, a chrome-containing composition, a cobalt-containing composition, a nickel-containing composition, an yttrium-containing composition, and any combination thereof. The coating can be spray deposited or dip coating deposited onto the inside surface of the exhaust chest (i.e., exhaust manifold). In some implementations, the exhaust manifold assembly can include a metallic surface comprising a base material, and the base material can include gray iron and/or aluminum.

In a related aspect, a method of making an exhaust manifold assembly for a uniflow-scavenged, opposed-piston engine includes applying a coating of a material of low thermal conductivity to an inside surface of the exhaust manifold assembly. The following features can be present in the method in any suitable combination. The method can include preparing interior surface of the exhaust manifold assembly for application of the coating. Additionally, or alternatively, the method can include treating the exhaust manifold assembly after application of the coating.

BRIEF DESCRIPTION OF THE DRAWINGS

In the figures.

FIG. 3 shows a close-up cross-sectional view of a coating on an inside surface of the exhaust manifold assembly of FIGS. 2A-2E.

FIG. 4 shows an exemplary method for making an exhaust manifold assembly according to this specification.

DETAILED DESCRIPTION OF PREFERRED EMBODIMENTS

An opposed-piston engine with an engine block having an exhaust manifold assembly and a thermal barrier coating on an inside surface of the exhaust manifold assembly is described. The thermal barrier coating, or coating layer, can serve to provide higher exhaust temperatures, reduce heat rejection to coolant in the engine, and allow for higher fatigue strength in the exhaust manifold and its structural features. Higher exhaust temperatures can improve an engine's fuel efficiency by increasing the exhaust enthalpy driving the engine's turbocharger. Additionally, or conversely, the higher exhaust temperatures can allow an engine's after-treatment system to light-off more quickly and maintain an operating temperature when the engine is operating at lower speeds or under lower loads. Also described herein are details of the coating, including methods for application of coating materials.

Figure 1:
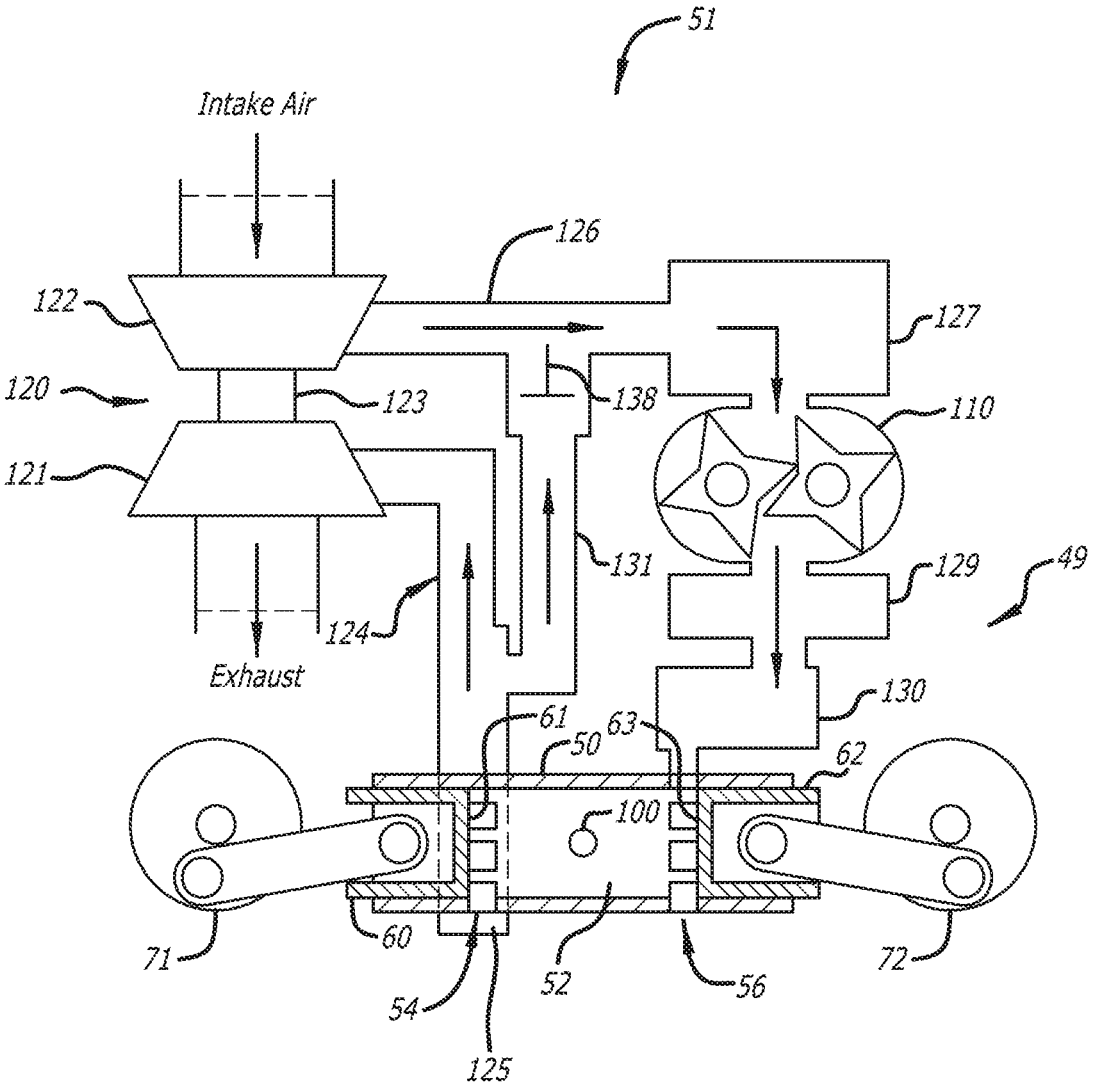
FIG. 1 (Prior Art)
FIG. 1 is a schematic diagram of an opposed-piston engine and auxiliary systems for use with the engine, and is properly labeled "Prior Art."

In FIG. 1, a uniflow-scavenged, two-stroke cycle internal combustion engine is embodied by an opposed-piston engine 49 having at least one ported cylinder 50. For example, the engine may have one ported cylinder, two ported cylinders, three ported cylinders, or four or more ported cylinders. Each ported cylinder 50 has a bore 52 and longitudinally-spaced exhaust and intake ports 54 and 56 formed or machined in respective ends of a cylinder wall. Each of the exhaust and intake ports 54 and 56 includes one or more circumferential arrays of openings in which adjacent openings are separated by a solid bridge. In some descriptions, each opening is referred to as a "port"; however, the construction of a circumferential array of such "ports" is no different than the port constructions shown in FIG. 1. In the example shown, the engine 49 further includes two crankshafts 71 and 72. The exhaust and intake pistons 60 and 62 are slidably disposed in the bore 52 with their end surfaces 61 and 63 opposing one another. The exhaust pistons 60 are coupled to the crankshaft 71, and the intake pistons are coupled to the crankshaft 72.

As the pistons 60 and 62 near TDC, a combustion chamber is defined in the bore 52 between the end surfaces 61 and 63 of the pistons. Fuel is injected directly into the combustion chamber through at least one fuel injector nozzle 100 positioned in an opening through the sidewall of a cylinder 50. The fuel mixes with charge air admitted into the bore through the intake port 56. As the air-fuel mixture is compressed between the end surfaces it reaches a temperature that causes combustion.

With further reference to FIG. 1, the engine 49 includes an air handling system 51 that manages the transport of charge air provided to, and exhaust gas produced by, the engine 49. A representative air handling system construction includes a charge air subsystem and an exhaust subsystem. In the air handling system 51, the charge air subsystem includes a charge source that receives fresh air and processes it into charge air, a charge air channel coupled to the charge air source through which charge air is transported to the at least one intake port of the engine, and at least one air cooler in the charge air channel that is coupled to receive and cool the charge air (or a mixture of gasses including charge air) before delivery to the intake port or ports of the engine. Such a cooler can comprise an air-to-liquid and/or an air-to-air device, or another cooling device. The exhaust subsystem includes an exhaust channel that transports exhaust products from exhaust ports of the engine for delivery to other exhaust components.

With further reference to FIG. 1, the air handling system 51 includes a turbocharger 120 with a turbine 121 and a compressor 122 that rotate on a common shaft 123. The turbine 121 is coupled to the exhaust subsystem and the compressor 122 is coupled to the charge air subsystem. The turbocharger 120 extracts energy from exhaust gas that exits the exhaust ports 54 and flows into an exhaust channel 124 directly from the exhaust ports 54, or from an exhaust manifold 125 that collects exhaust gasses output through the exhaust ports 54. In this regard, the turbine 121 is rotated by exhaust gas passing through it. This rotates the compressor 122, causing it to generate charge air by compressing fresh air. The charge air subsystem includes a supercharger 110. The charge air output by the compressor 122 flows through a charge air channel 126 to a cooler 127, whence it is pumped by the supercharger 110 to the intake ports. Charge air compressed by the supercharger 110 can be output through a cooler 129 to an intake manifold 130. The intake ports 56 receive charge air pumped by the supercharger 110, through the intake manifold 130. Preferably, in multi-cylinder opposed-piston engines, the intake manifold 130 is constituted of an intake plenum that communicates with the intake ports 56 of all cylinders 50.

In some aspects, the air handling system shown in FIG. 1 can be constructed to reduce NOx emissions produced by combustion by recirculating exhaust gas through the ported cylinders of the engine. The recirculated exhaust gas is mixed with charge air to lower peak combustion temperatures, which reduces production of NOx. This process is referred to as exhaust gas recirculation ("EGR"). The EGR construction shown obtains a portion of the exhaust gasses flowing from the port 54 during scavenging and transports them via an EGR loop external to the cylinder into the incoming stream of fresh intake air in the charge air subsystem. Preferably, the EGR loop includes an EGR channel 131. The recirculated exhaust gas flows through the EGR channel 131 under the control of a valve 138 (this valve may also be referred to as the "EGR valve").

Figure 2A:
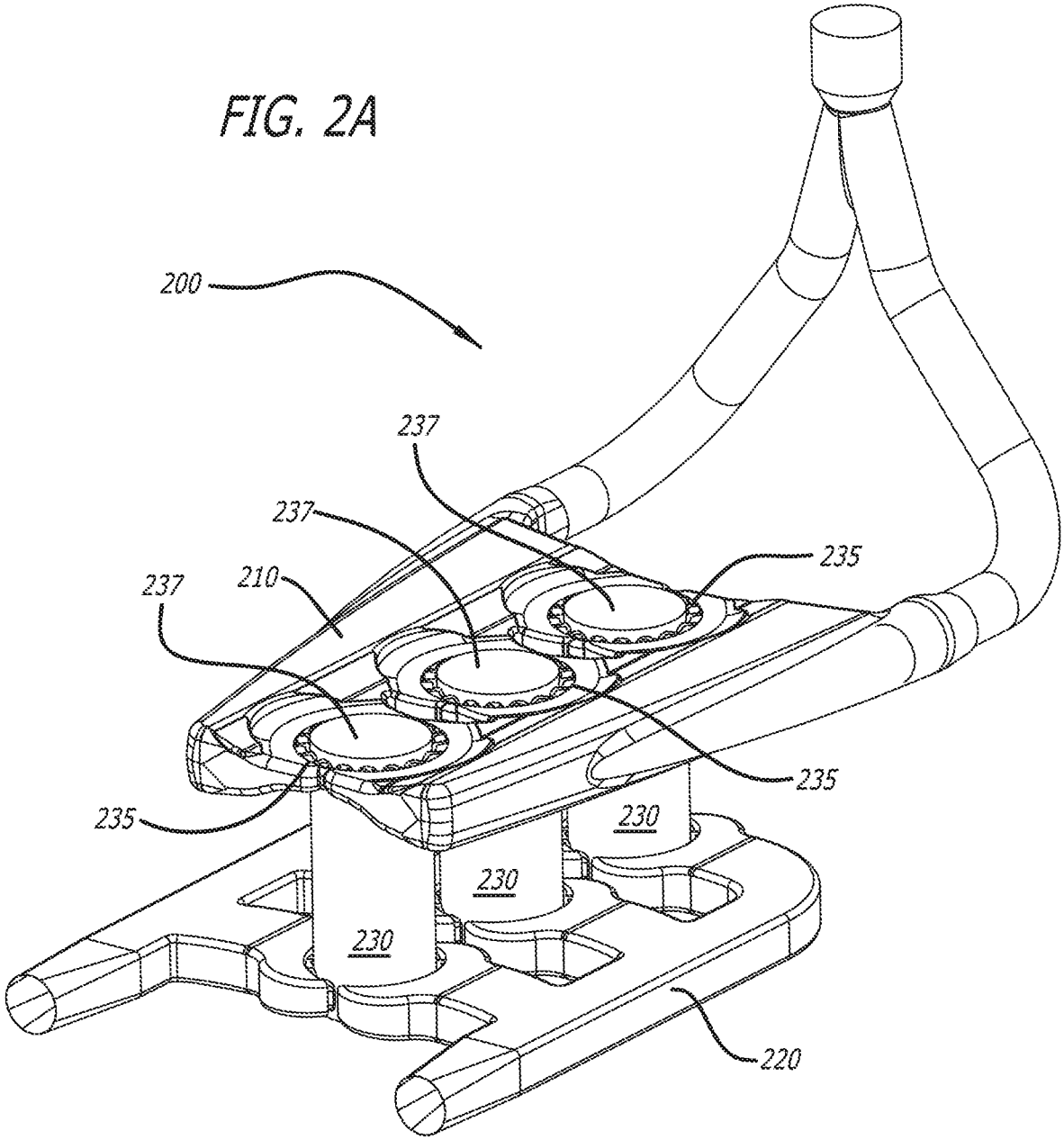
FIGS. 2A-2E show an exemplary exhaust manifold assembly according to this disclosure.

FIG. 2A shows parts of an engine 200 with an intake manifold 210, an exhaust manifold assembly 220, including three substantially tubular cylinder liners 230 for cylinders, each liner 230 retained in a respective tunnel in the engine block of the engine 200. Each of the cylinder liners 230 has an intake port 235 and an exhaust port 236 (shown in FIGS. 2B and 2C). Each intake port and exhaust port has an array of port openings that extend from the cylinder bore 237 to the air handling system (i.e., intake or exhaust manifold, respectively; exhaust treatment system; exhaust gas recirculation system).

Figure 2B:
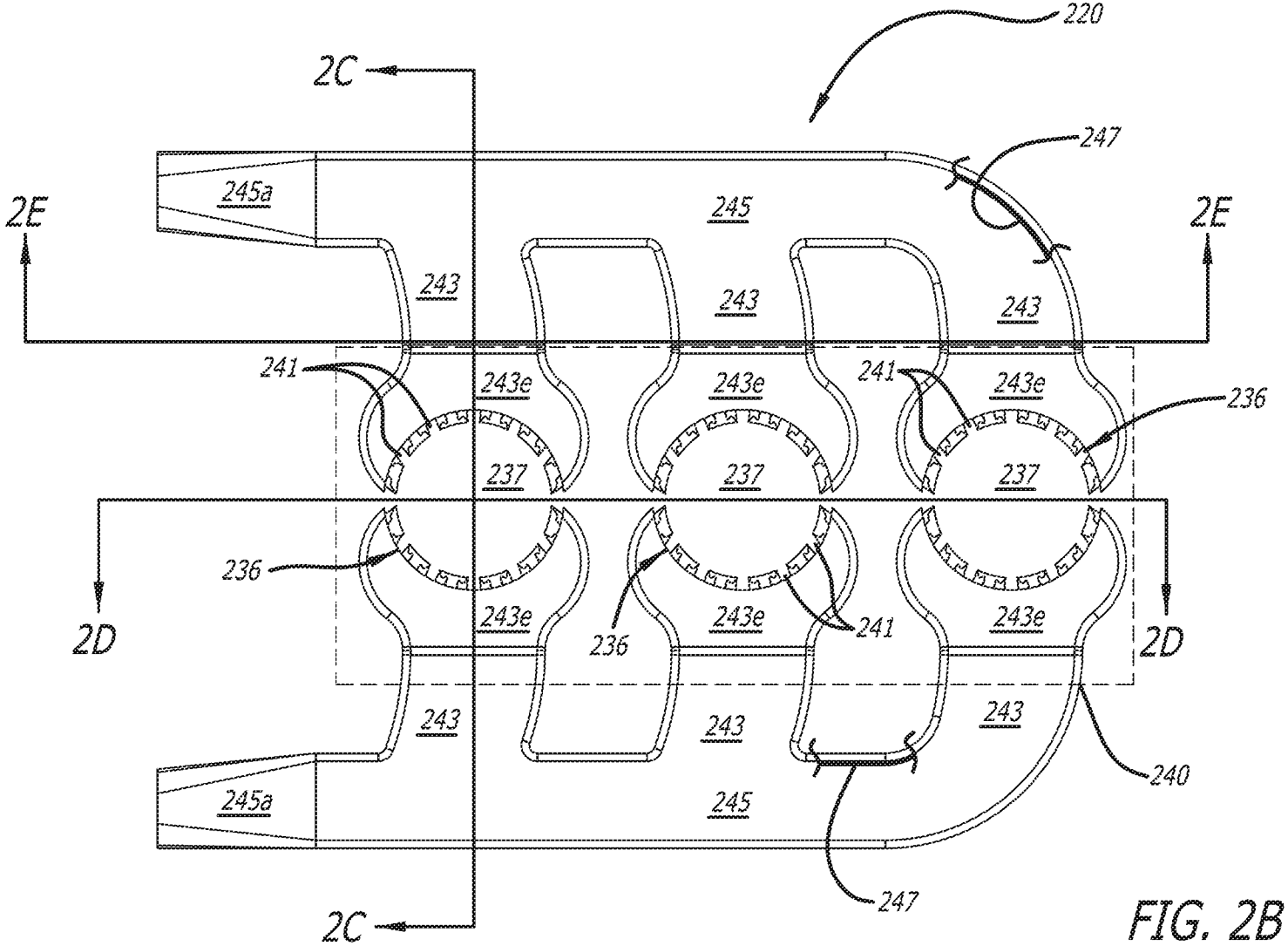
Figure 2C:
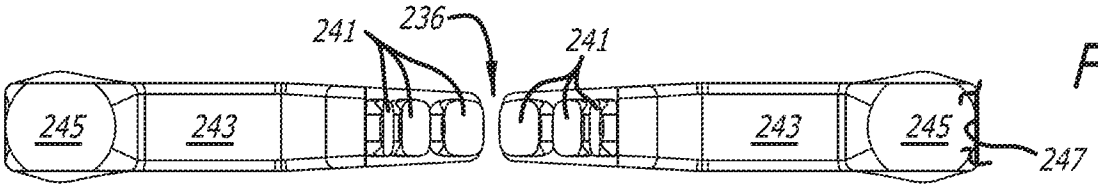
Figure 2D:
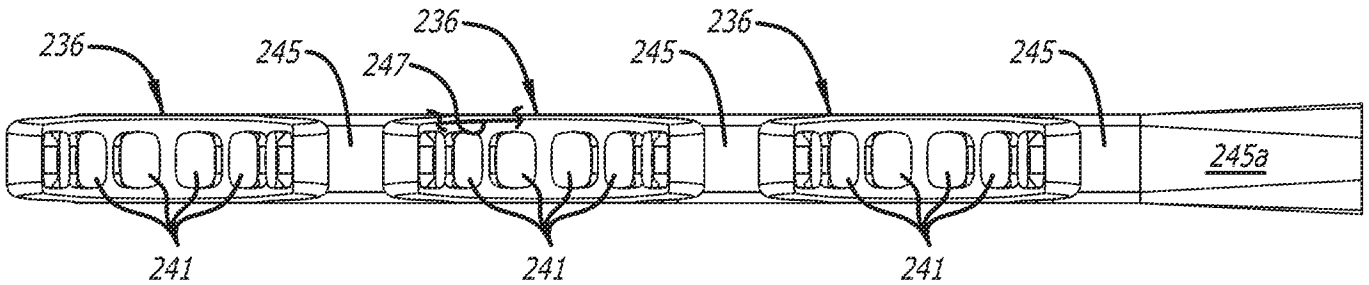
Figure 2E:
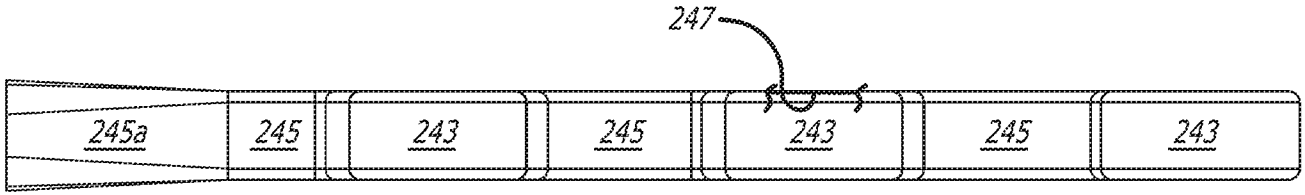

FIGS. 2B-2E show views of an exhaust manifold assembly 220 for use with the opposed-piston engine 200 shown in FIG. 2A that can be coated with a thermally resistive material (e.g., a thermal barrier coating). FIG. 2B is a cross-sectional plan view of the exhaust manifold assembly 220 showing three cylinder bores 237, cut through the exhaust ports 236 and exhaust port openings 241. An outline of the boundaries of an engine block 240 surrounding the cylinder bores 237 is shown in FIG. 2B. The exhaust manifold assembly 220 includes a pair of runner portions (e.g., runner plenums) 243*e* in the engine block 240 that surround each exhaust port 236, as well as an exhaust runner 243 connecting each runner portion 243*e* in the engine block 240 to an exhaust pipe 245. The runner portions 243*e* of the exhaust manifold assembly can be formed in the engine block 240, with the runners 243 and exhaust pipes 245 attaching to the engine block 240. The exhaust manifold assembly 220 shown in FIG. 2B has two exhaust pipes 245, one on each side of the assembly. Each exhaust pipe 245 has a connecting portion 245*a* that joins the exhaust manifold assembly 220 to an exhaust treatment system, exhaust gas recirculation system, or both an exhaust treatment system and an exhaust gas recirculation system. In FIG. 2B, lines are shown that indicate the planes from which the elevation views shown in FIG. 2C-FIG. 2E are taken. In FIGS. 2B-2E, a coating of thermal barrier material 247 is shown on the inside surface of the exhaust runner portions 243*e* in the engine block 240, exhaust runners 243, and exhaust pipes 245.

The configuration shown in FIGS. 2A-2E are exemplary, and the exhaust manifold assembly 220 can be used with an engine of one, two, three, four, or more cylinders. In an exhaust manifold assembly 220, exhaust pipe connecting portions 245*a* can have the orientation and configuration shown in FIGS. 2A-2E, or the exhaust pipe connecting portions 245*a* can be oriented in any suitable direction or located at any point along a respective exhaust pipe 245 to accommodate the packaging of the engine, including air handling components (e.g., exhaust gas treatment systems, exhaust gas recirculation system).

Engine blocks, or alternately cylinder blocks, of opposed-piston engines can be constructed of various materials. However, for ease of manufacturing, as well as because of suitable mechanical properties over a wide range of temperatures, irons and steels have been the materials of choice for making engine blocks. Though the engine blocks, and thus the exhaust manifold assemblies, described herein are discussed as being of gray iron, other materials can be used, such as aluminum.

The fatigue strength of any metal used for the base metal of the exhaust manifold can vary as a function of temperature. For example, FIG. 10-2 of the Atlas of Fatigue Curves shows fatigue limit strength as a function of temperature for gray iron. At 600 deg. C., gray iron has fatigue limit strength of approximately 5 to 7.5 KSI (thousands of pounds per square inch). (Boyer, Howard E., "Atlas of Fatigue Curves," ASM International; Materials Park, 1986, FIG. 10-2, Page. 246). Exhaust gas temperatures in opposed-piston engines, as described above, can range from 500 deg. C. to 700 deg. C. Coating layers (e.g., thermal barrier coatings) applied to the inside surface of a gray iron exhaust manifold can reduce the temperature experienced by the gray iron by 100 deg. C. to 350 deg. C. Effectively, the gray iron of an exhaust manifold with a barrier coating can have higher fatigue limit strengths with values between approximately 15 KSI to approximately 23 KSI.

FIG. 3 shows a close-up, cross-sectional view 300 of a coating on an inside surface of the exhaust manifold of FIGS. 2A-2E. The base metal 310 of the exhaust manifold, for example gray iron, is shown with a coating layer 320 on it with an interface 325 between. The coating layer 320 can have a thickness of between 150 microns and 800 microns, such as between 300 microns and 600 microns. In some implementations, a coating layer on the inner surface of an exhaust manifold can have a thickness between approximately 400 microns and 500 microns.

In general, desirable thermal layer characteristics of the coating layer can include any of low thermal conductivity, thermal fatigue resistance, thermal shock resistance, high-temperature oxidation and corrosion resistance, the ability to radiate heat back to exhaust, and the ability to lower heat rejection outside of the exhaust manifold. The coating layer can include a thermally insulating material, which may be a low heat capacity material. At the interface 325, the base metal 310 can have a surface roughness that allows for good adhesion of the coating layer 320. Thus, the adhesion of the coating layer 320 on the base metal can have a value between 3000 and 5000 PSI (pounds per square inch) when tested using standard mechanical tests.

Materials for the coating layer can include any of a metal, a ceramic, a composite (e.g., cermet), a polymer, a densified material, and a porous material impregnated with polymer or ceramic. Exemplary ceramic materials can include alumina, zirconia, fosterite, mullite, yttria-stabilized zirconia (YSZ). Further, metals used for the coating material can include silicon, nickel, molybdenum, chromium, cobalt, yttrium, aluminum, and alloys thereof. Materials preparation methods for the coating can include any of spray deposition (e.g., plasma spray), electron beam physical vapor deposition (EB-PVD), slurry coating (spray and dip coating), electrolytic processes, and sol-gel processes.

Porosity of the material of the coating layer can be between 10-15 volume %. The coating layer can have a coefficient of thermal expansion (a) between 4 and $17\times10^{-6}$ cm/(cm·K), such as between 7.5 and $10.5\times10^{-6}$ cm/(cm·K). Another measurable characteristic is the thermal conductivity of a material. The coating layer can have a thermal conductivity value of between approximately 1 and 8 W/(m·K).

As described above, particularly with respect to the plot shown in Boyer, a coating layer (e.g., thermal barrier layer), may reduce the temperature experienced by the base metal of an exhaust manifold during operation of an engine, so that the temperature of the base metal (e.g., gray iron) is below about 450 or 500 degrees C. (Boyer, cited above). For gray iron, at temperatures of about 500 degrees C. and below, the fatigue limit is a factor of 2 or 3 of what it is at about 600 degrees C. This means that by maintaining the gray iron of the exhaust manifold below about 500 degrees C., the structural integrity of the manifold can be maintained for a greater amount of time than at the temperature of exhaust gas leaving the engine's cylinders (e.g., about 600 degrees C. or greater).

Similarly, the flow of coolant around and through an exhaust manifold while an engine operates may help maintain the temperature of the base metal below a threshold point (e.g., about 500 degrees C.) to help maintain the fatigue strength and structural robustness of the manifold. In exhaust manifold configurations with both passageways for conveying coolant and a thermal barrier coating, there may be even greater likelihood that the temperature of the base metal (e.g., gray iron) is maintained at or below a temperature that allows for optimal fatigue strength, and thus maintenance of the integrity of the exhaust manifold. Further, the presence of a thermal barrier coating (e.g., coating layer) in an exhaust manifold of an opposed-piston engine may reduce the cooling needs of the engine. A reduction in cooling needs may allow the cooling system to employ a smaller pump, thus reducing pumping loads, as well as allowing for a smaller grill and other parts of the cooling system.

FIG. 4 shows an exemplary method 400 for making an exhaust manifold of an opposed-piston, uniflow scavenged, two-stroke engine. Initially, the method includes preparing the interior surface of an exhaust manifold of an opposed-piston engine for a coating layer, as in 410. The preparation of the interior surface can include any of cleaning, etching, roughening, smoothing, machining, chemical activation, and the application of a bonding layer. Then, the method includes coating the interior surface of the exhaust manifold with a thermal barrier coating, as in 420. Optionally, the method also includes treating the exhaust manifold after application of the thermal barrier coating so that the opposed-piston engine is prepared for use, as in 430. Treating the exhaust manifold can include a heat treatment, surface finishing, and the like.

Those skilled in the art will appreciate that the specific embodiments set forth in this specification are merely illustrative and that various modifications are possible and may be made therein without departing from the scope of the invention which is defined by the following claims.

What is claimed is:

1. An opposed-piston engine comprising:

an engine block;

a plurality of cylinders disposed in the engine block, each cylinder including a cylinder wall having an interior surface defining a bore centered on a longitudinal axis of the cylinder and an intake port and an exhaust port formed in the cylinder wall near respective opposite ends of the cylinder, the intake and exhaust ports each including an array of port openings extending through the cylinder wall to the bore;

an exhaust manifold assembly comprising at least one exhaust pipe, and, for each cylinder, a pair of runner portions forming a runner plenum in the engine block that surrounds the exhaust port openings of the cylinder, each runner portion connected to a respective runner, at least one runner connected to the at least one exhaust pipe; and, a coating layer on an inside surface of the exhaust manifold assembly that reduces heat transfer from exhaust gas to the engine block.

2. The opposed-piston engine of claim 1, wherein the exhaust manifold assembly includes a base metal that comprises gray iron.

3. The opposed-piston engine of claim 1, wherein the coating layer comprises a thermally insulating material.

4. The opposed-piston engine of claim 3, wherein the thermally insulating material has a coefficient of thermal conductivity between 1 and 8 W/(m·K).

5. The opposed-piston engine of claim 3, wherein the coating layer comprises any one of zirconia, alumina, a chrome-containing composition, a cobalt-containing composition, a nickel-containing composition, and an yttrium-containing composition, or any combination thereof.

6. The opposed-piston engine of claim 3, wherein the coating layer is spray deposited or dip coating deposited onto the inside surface of the exhaust manifold assembly.

7. The opposed-piston engine of claim 1, wherein the plurality of cylinders being disposed in an inline array.

8. The opposed-piston engine of claim 7, wherein each cylinder comprises a liner retained in a tunnel in the cylinder block.

9. The opposed-piston engine of any one of claims 1 or 7, wherein the at least one exhaust pipe being in fluid communication with one or more of: a turbine inlet; an EGR inlet; and an exhaust treatment system.

10. A method of making an exhaust manifold assembly for an opposed-piston engine with a plurality of cylinders disposed in an engine block, comprising:

providing an exhaust manifold assembly comprising at least one exhaust pipe, and, for each cylinder, a pair of runner portions forming a runner plenum in the engine block that surrounds exhaust port openings of the cylinder, each runner portion connected to a respective runner, at least one runner connected to the at least one exhaust pipe: and, applying a coating layer comprising a material having a thermal conductivity between 1 and 8 W/(m·K) to an interior surface of the exhaust manifold.

11. The method of claim 10, further comprising preparing the interior surface of the exhaust manifold assembly for application of the coating layer.

12. The method of either claim 10 or 11, further comprising treating the exhaust manifold assembly after application of the coating layer.

* * * * *